US007922630B1

(12) United States Patent
Batca

(10) Patent No.: US 7,922,630 B1
(45) Date of Patent: Apr. 12, 2011

(54) ADJUSTABLE BICEP CURL SUPPORT PADS

(76) Inventor: Roger Batca, Durham, NC (US)

( * ) Notice: Subject to any disclaimer, the term of this patent is extended or adjusted under 35 U.S.C. 154(b) by 0 days.

(21) Appl. No.: 12/572,496

(22) Filed: Oct. 2, 2009

Related U.S. Application Data

(63) Continuation-in-part of application No. 11/763,509, filed on Jun. 15, 2007.

(60) Provisional application No. 60/814,008, filed on Jun. 15, 2006, provisional application No. 61/195,145, filed on Oct. 3, 2008.

(51) Int. Cl.
*A63B 21/06* (2006.01)

(52) U.S. Cl. ..... 482/94; 482/100; 482/142

(58) Field of Classification Search ..... 482/93, 482/94, 98–100, 102, 142; 297/411.3, 411.31, 297/411.35, 411.36
See application file for complete search history.

(56) References Cited

U.S. PATENT DOCUMENTS 5,897,467 A * 4/1999 Habing et al. ..... 482/100
6,056,678 A * 5/2000 Giannelli et al. ..... 482/137
6,099,445 A * 8/2000 Rovinsky et al. ..... 482/121
6,213,552 B1 * 4/2001 Miotto ..... 297/300.5
6,619,747 B2 * 9/2003 Ko et al. ..... 297/423.12
7,036,882 B2 * 5/2006 Elzenbeck ..... 297/300.1
7,090,303 B2 * 8/2006 Kropa ..... 297/466
7,361,127 B2 * 4/2008 Tremayne ..... 482/130
2003/0100413 A1 * 5/2003 Huang ..... 482/100

* cited by examiner

*Primary Examiner* — Rinaldi I Rada
*Assistant Examiner* — Andrew M Tecco
(74) *Attorney, Agent, or Firm* — Coats & Bennett, P.L.L.C.

(57) ABSTRACT

A multi station exercise gym includes a pair of bicep curl pivot assemblies pivotally attached to a user support assembly. Each bicep curl pivot assembly includes a pivotally attached support pad assembly. The user support assembly, bicep curl pivot assemblies, and support pad assemblies can be adjusted to multiple positions to support a user's arms during multiple variations of bicep curl exercise. The bicep curl pivot assemblies can also be adjusted into respective storage positions to prevent interference when performing unsupported bicep curl exercises or other exercise movements on the multi station exercise gym. The bicep curl pivot assemblies can also be pivotally attached to a free standing exercise bench.

20 Claims, 10 Drawing Sheets

ADJUSTABLE BICEP CURL SUPPORT PADS

RELATED APPLICATIONS

This application is being filed as a continuation-in-part of U.S. patent application Ser. No. 11/763,509, filed Jun. 15, 2007, which claims priority to U.S. Provisional Application 60/814,008 filed Jun. 15, 2006; and also claims priority to U.S. Provisional Patent Application No. 61/195,145, filed Oct. 3, 2008, all of which are incorporated herein by reference.

FIELD OF THE INVENTION

The present invention is directed generally to exercise equipment and, more particularly, to a multi-station exercise gym which includes a station for performing bicep curls in multiple positions.

BACKGROUND

Various types of exercise machines for strengthening and conditioning the body are known. One group of exercise machines are categorized as multi station gyms. Multi station gyms combine multiple exercise stations onto one frame, typically sharing one user support seat, in order to save space and cost. Also, most multi station gyms typically have one resistance source shared buy all the stations to further save cost. The resistance source is usually a weight stack wherein a cable system interconnects all the exercise stations to the weight stack. Since all the exercise stations share the same frame and typically the same resistance source, the exercise stations will be close to one another and must cooperatively work with one another wherein the exercise movement of one station will not interfere with the movement of another exercise station.

One common design of a multi station gym includes a user support bottom seat and back seat near the front of the gym and a weight stack near the back of the gym. This common design usually includes one or two arms pivotally attached to the frame above the user support seating for pressing and pulling exercises. This common design usually also includes at least one free cable end within a cable system wherein a bicep curl bar can be attached. To perform bicep curls, a user would stand in front of the free cable end, grasp the bicep curl bar, and perform standing bicep curls.

A common belief among fitness professionals is that exercising ones muscles from multiple angles and positions will prevent the muscles from getting use to one certain exercise position or motion, thus allowing continued muscle growth with these varied exercise routines. Also, it is important to vary exercise routines to prevent individuals from getting bored with their routine. It would be advantageous to have the above mentioned multi station design wherein bicep curls could be performed from multiple positions without increasing the space required to house the multi station gym.

U.S. patent application Ser. No. 11/763,509 filed Jun. 15, 2007 wherein Roger Batca is the inventor, shows two bicep curl pad assemblies pivotally attached to a user support assembly. Each bicep curl pad assembly can be adjusted into a respective use position. While sitting on the user support assembly facing forward, a user can grasp two handles and brace their upper arms and/or elbows on the bicep curl pad assemblies and perform seated arm supported bicep curls while their upper arms are supported in a generally vertical position. This allows variation from the standing bicep curl exercise mentioned above. Each bicep curl pad assembly can then be adjusted into a respective storage position wherein the bicep curl pad assemblies will not interfere with the exercise movements of the user while they perform chest presses or mid row pulls with the exercise arms.

SUMMARY

The present invention is a multi station gym which includes an exercise station for performing bicep curl exercises and an exercise station for performing chest presses and mid row pulls. The multi station exercise gym comprises a frame, and in one exemplary embodiment, a weight stack as the resistance element, a pair of exercise arms pivotally attached to the frame, a user support assembly pivotally attached to the frame, two bicep curl pad assemblies pivotally attached to the user support assembly, and two handle assemblies attached to two free flexible line ends for performing bicep curls. A flexible line and pulley system connects the exercise arms and handle assemblies to the weight stack and in the exemplary embodiment, the flexible line and pulley system is a cable and pulley system.

It is an object of the present invention to provide variations for performing bicep curl exercises. In the exemplary embodiment, two bicep curl pad assemblies are pivotally attached to the user support assembly. A respective bicep curl pad assembly comprises a bicep curl pivot assembly and a support pad assembly pivotally attached to the bicep curl pivot assembly. In a first variation, the user support assembly can be adjusted towards a rearward position, each bicep curl pivot assembly can be adjusted into a respective use position, and each support pad assembly can be adjusted to a respective generally vertical position. While sitting on the user support assembly facing forward, a user can grasp two handles and brace their upper arms and/or elbows on the support pad assemblies and perform seated arm supported bicep curls while their upper arms are supported in a generally vertical position.

In a second variation, the user support assembly can be adjusted towards a forward position, each bicep curl pivot assembly can be adjusted into a respective use position, and each support pad assembly can be adjusted into a respective generally horizontal position. While sitting on the user support assembly facing towards the back of the gym, a user can grasp two handles and brace their upper arms and/or elbows on the support pad assemblies and perform seated arm supported bicep curls while their upper arms are supported in a generally horizontal position.

Each bicep curl pad assembly can be adjusted into a respective storage position wherein the bicep curl pad assemblies will not interfere with the exercise movements of the user while they perform unsupported bicep curls, or chest presses and mid row pulls with the exercise arms. When each bicep curl pad assembly is adjusted into a respective storage position, each support pad assembly can be adjusted into a respective generally vertical or generally horizontal position and not interfere with other exercise movements.

In an alternate embodiment, a bicep curl pad assembly can be made wherein a support pad is always in a fixed generally horizontal position.

In another alternate embodiment, a pair of bicep curl pad assemblies can be pivotally attached to a user support assembly such as a free standing bench.

DETAILED DESCRIPTION

Figure 1:
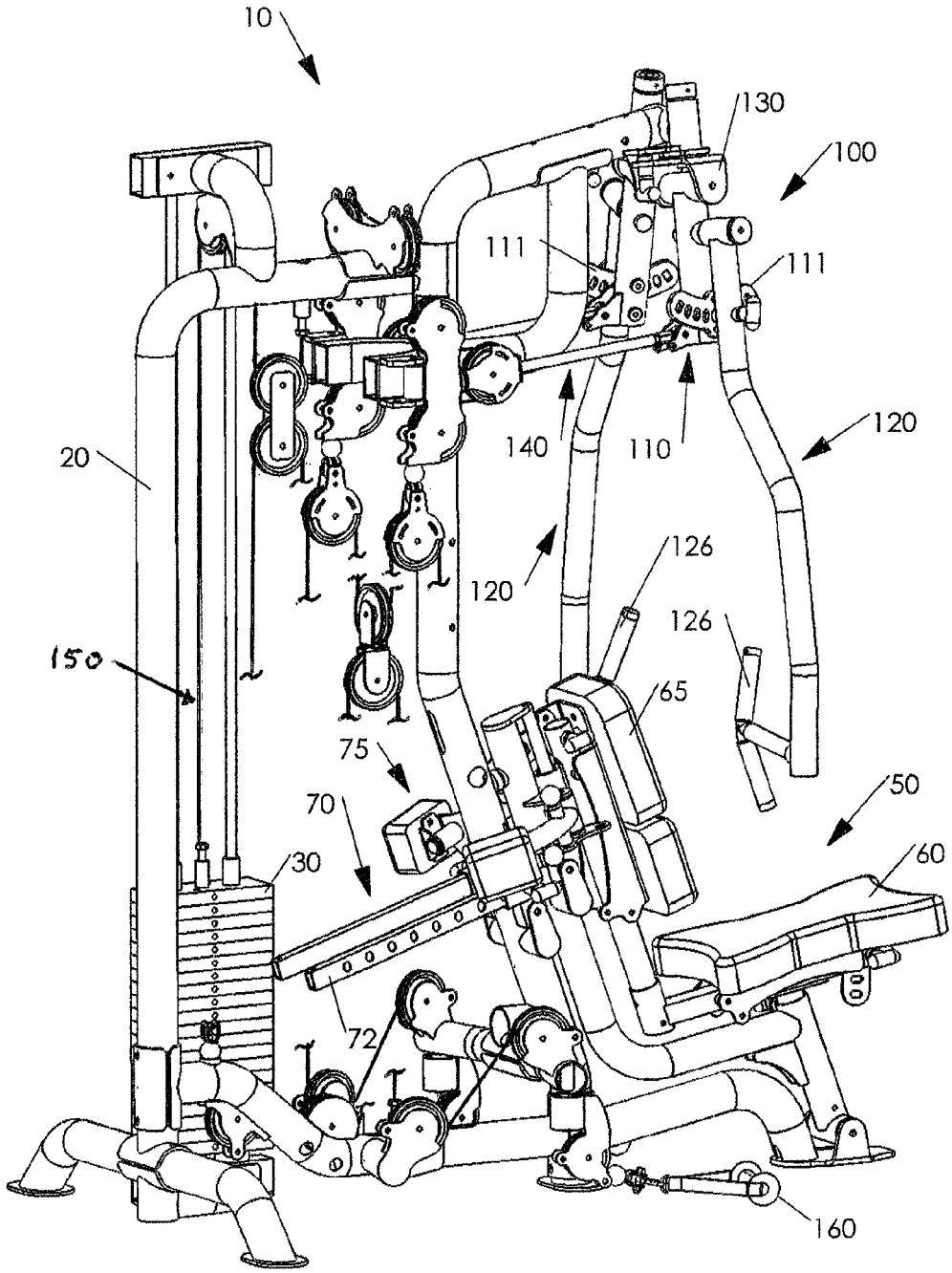
FIG. 1 is a perspective view illustrating an exemplary multi station gym from the back right side wherein the user support assembly is pivotally adjusted towards a rearward position, each exercise arm is adjusted into a position for performing chest presses, and each bicep curl pad assembly is adjusted into a respective storage position.
Figure 1:
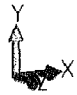

Referring now to the drawings, a multi station gym according to the present invention is shown therein and indicated generally by the numeral 10. The multi station gym comprises a frame 20, weight stack 30 or other resistance element, user support assembly 50, bicep curl pad assemblies 75, arm assembly 100, handles 160, and a connecting assembly 150 interconnecting the arm assembly 100 and the handles 160 with the resistance element 30. The exemplary embodiment show in the drawings is for performing chest press exercises, mid row exercises, and bicep curl exercises. In the exemplary embodiment, the connecting assembly 150 is a cable and pulley system. Those skilled in the art would appreciate that other flexible lines such as belts, straps, chains, ropes, or cords could be used to carry out the present invention. Also, those skilled in the art would appreciate that there are numerous configurations of cables and pulleys that could be used to carry out the present invention.

The frame 20, illustrated in FIGS. 1-4, provides structural support and stability to the multi station gym 10. The frame 20 also provides connection points for the resistance element 30, the user support assembly 50, arm assembly 100 and pulleys within connecting assembly 150.

In the exemplary embodiment, the resistance element 30 is a weight stack which is illustrated in FIGS. 1-4. Weight stacks are commonly used as a resistance element in the art of strength training. Those skilled in the art will appreciate that other resistance devices, such as electronic resistance devices, magnetic breaks, hydraulic cylinders, elastic bands, free weights, or pneumatic resistance may also be used to practice the present invention.

The arm assembly 100, illustrated in FIGS. 1-4, includes respective first arm sections 110 pivotally attached to respective swivel pulley assemblies 130. The swivel pulley assemblies 130 are pivotally attached to the frame 20. The arm assembly also includes respective second arm sections 120 which are pivotally attached to respective first arm sections 110. A respective pulley assembly 140 is pivotally attached to a respective first arm section 110 and interconnects the arm assembly 100 with the weight stack 30 by way of cable and pulley system 150. A two axis arm assembly with similar components is described in more detail in U.S. patent application Ser. Nos. 11/254,576 and 11/346,528 and 11/584,327 wherein Roger Batca is the inventor.

Figure 5:
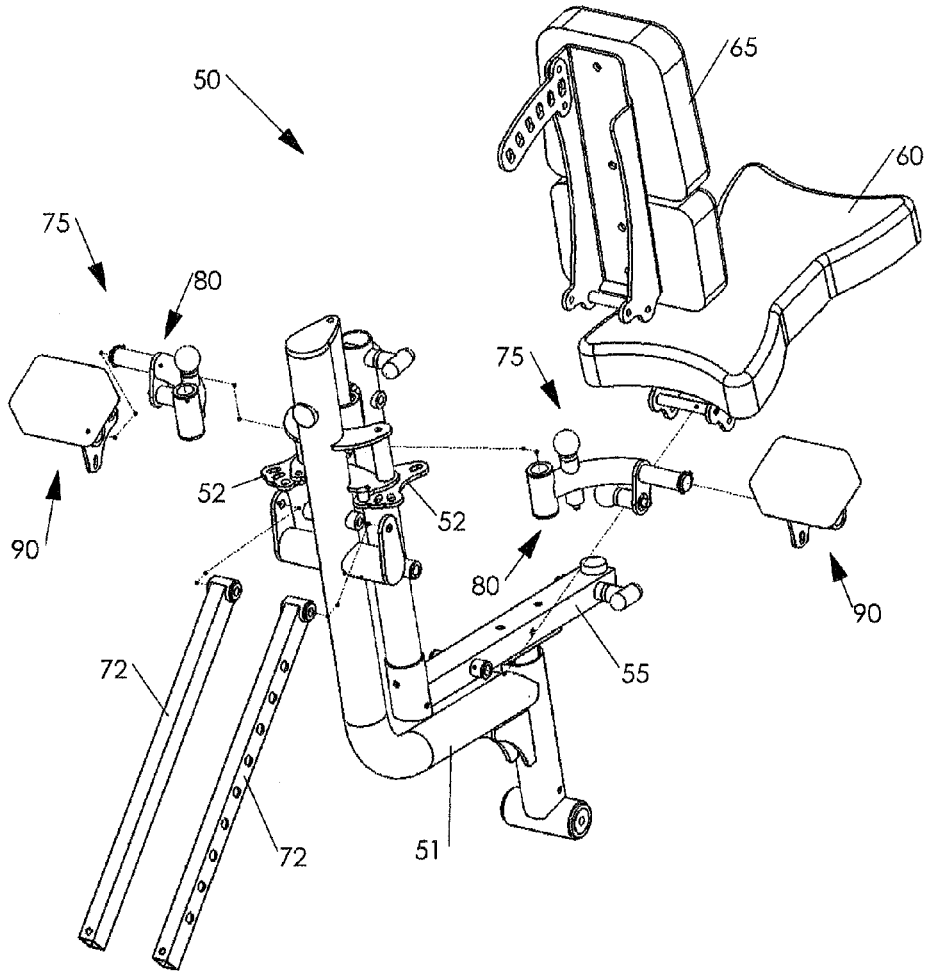
FIG. 5 is an exploded view illustrating an exemplary user support assembly including two bicep curl pad assemblies.
Figure 5:
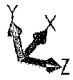

The user support assembly 50, which is illustrated in greater detail in FIG. 5, includes a bottom seat pad assembly 60 and a back seat pad assembly 65 that are pivotally attached to seat sub frame 55, which is telescopically adjustable with seat main frame 51, and are angularly adjustable to accommodate various user positions for various exercises. The user support assembly 50 also includes adjustment mechanism 70, which includes adjustment tubes 72 and adjustment sleeves 71 (shown in FIG. 2), to adjust and position the user support assembly 50 to various locations to support the user for various exercises. A similar user support assembly 50 is described in U.S. patent application Ser. No. 11/763,509 filed Jun. 15, 2007 wherein Roger Batca is the inventor.

Figure 6:
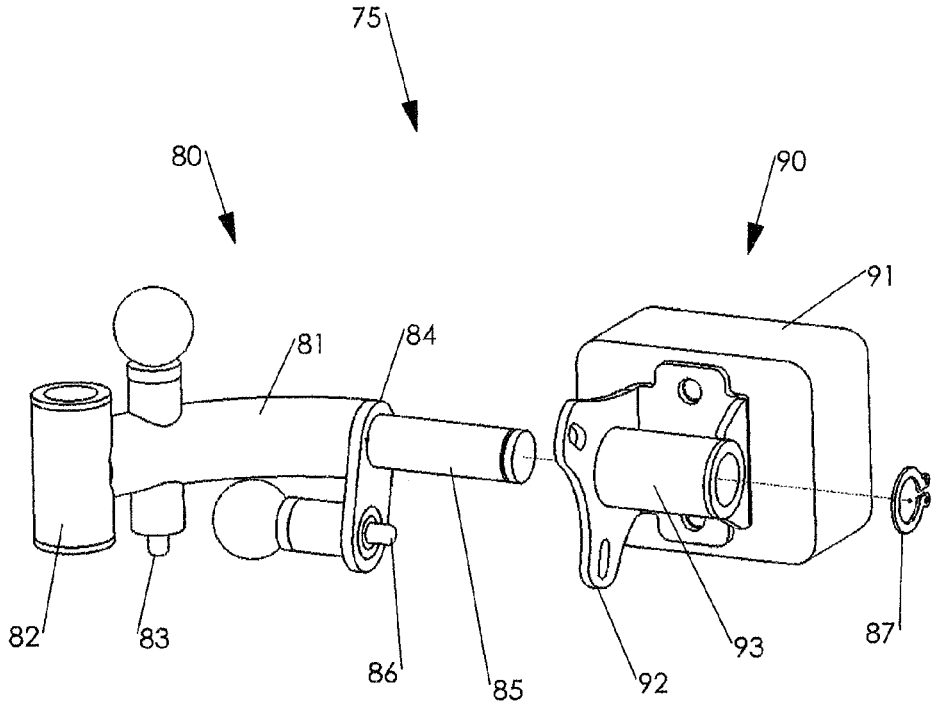
FIG. 6 is an exploded view illustrating an exemplary bicep curl pad assembly.
Figure 6:
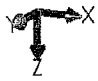

The user support assembly 50 also includes bicep curl pad assemblies 75. The bicep curl pad assemblies 75 secure the users upper arms in a stable position as they perform bicep curls. As illustrated in FIG. 5, there is a left bicep curl pad assembly 75 and a right bicep curl pad assembly 75. Each respective bicep curl pad assembly 75 is pivotally attached to the seat main frame 51. As illustrated in FIG. 6, a respective bicep curl pad assembly 75 comprises a bicep curl pivot assembly 80 wherein a support pad assembly 90 is pivotally attached. A respective bicep curl pivot assembly 80 comprises extension tube 81 wherein bushing tube 82 is attached at one end, and locking pin plate 84 along with axle 85 is attached at the other end. Locking pin 83 is attached to extension tube 81 near one end and engages one of multiple apertures in locking plate 52 (shown in FIG. 5) and secures the bicep curl pad assembly 75 to seat main frame 51. Locking pin 86 is attached to locking pin plate 84.

A respective support pad assembly 90 comprises support pad 91 which is secured to pad bracket 92. Bushing tube 93 is attached to bracket 92 and provides a housing to pivotally attach support pad assembly 90 to bicep curl pivot assembly 80 wherein locking pin 86 engages one of multiple apertures in pad bracket 92. Snap ring 87 secures support pad assembly 90 to bicep curl pivot assembly 80.

Each respective bicep curl pad assembly 75 can be adjusted from a storage position to a use position. Those skilled in the art would appreciate that multiple storage apertures could be added to locking plate 52 to vary the storage positions for the bicep curl pad assemblies 75 as well as multiple use apertures could be added to locking plate 52 to vary the angle of the bicep curl pad assemblies 75 during use.

Each respective support pad assembly 90 can be pivotally adjusted about a respective bicep curl pivot assembly 80 wherein the front of support pad 91 is in a generally vertical position or in a generally horizontal position. In the horizontal position, the front of support pad 91 is at a further distance from the floor, thus allowing a user to lift and support their upper arms in this horizontal position. Those skilled in the art would appreciate that multiple apertures could be added to pad bracket 92 in order to vary the angle of support pad assembly 90. Also, those skilled in the art would appreciate that support pad assembly 90 could be made to pivot freely wherein the angle of support pad assembly 90 would be dependant on the angle of pressure from the user's upper arm while performing bicep curl exercises.

FIG. 1 illustrates each bicep curl pad assembly 75 adjusted into a respective storage position, user support assembly 50 adjusted to a rearward position, and each second arm section 120 adjusted to a middle position engaged with a respective locking plate 111. A user would now be able to sit on user support assembly 50 facing forward and grasp handles 126 of the arm assembly 100 and perform chest presses without interference from the bicep curl pad assemblies 75.

Figure 2:
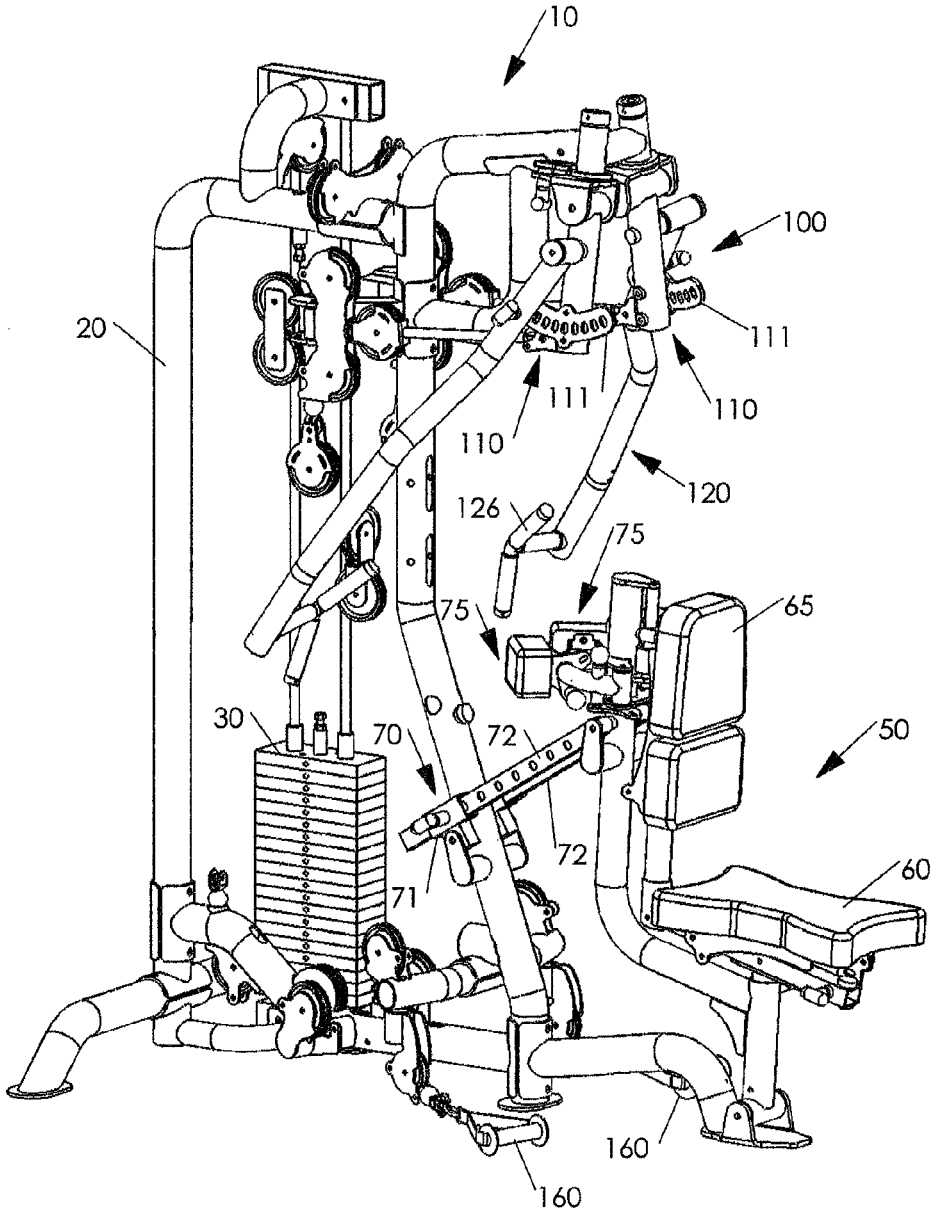
FIG. 2 is a perspective view illustrating an exemplary multi station gym from the front right side wherein the user support assembly is pivotally adjusted towards a forward position, each exercise arm is adjusted into a position for performing mid row pulls, and each bicep curl pad assembly is adjusted into a respective storage position.
Figure 2:
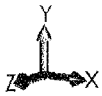

FIG. 2 illustrates each bicep curl pad assembly 75 adjusted into a respective storage position, user support assembly 50 adjusted to a forward position, and each second arm section 120 adjusted to a rearward position engaged with a respective locking plate 111. A user would now be able to sit on user support assembly 50 facing towards the back of the gym 10 and grasp handles 126 of the arm assembly 100 and perform mid row pulls without interference from the bicep curl pad assemblies 75.

Figure 3:
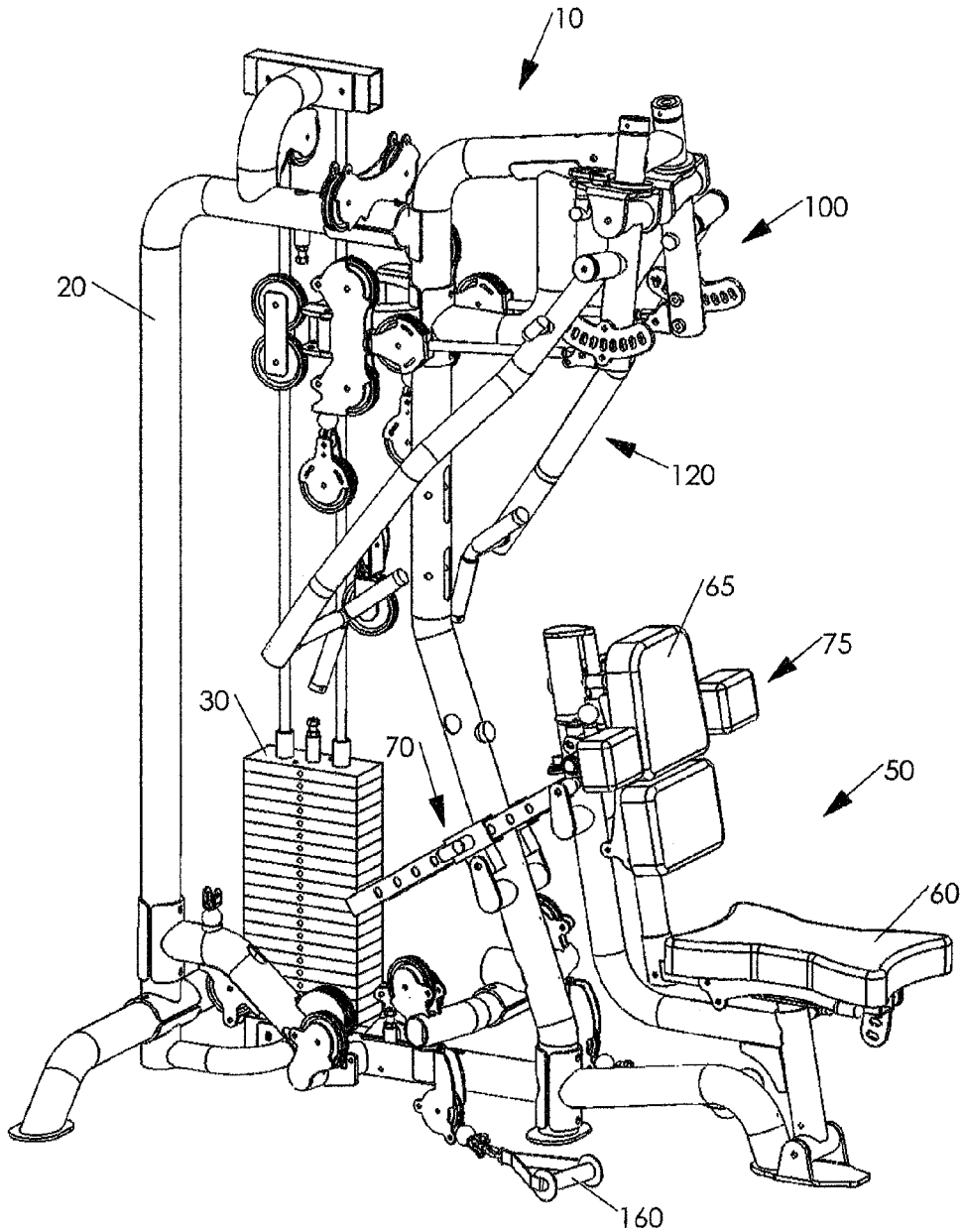
FIG. 3 is a perspective view illustrating an exemplary multi station gym from the front right side wherein the user support assembly is pivotally adjusted to a slightly rearward position, each exercise arm is adjusted into an out of the way position, each bicep curl pad assembly is adjusted into a respective use position, and each support pad assembly is adjusted into a respective generally vertical position.
Figure 3:
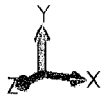

FIG. 3 illustrates each bicep curl pad assembly 75 adjusted into a respective use position wherein each support pad assembly 90 is adjusted into a respective generally vertical position. The user support assembly 50 is adjusted towards a slightly rearward position and each second arm section 120 is adjusted to a rearward position engaged with a respective locking plate 111. While sitting on the user support assembly 50 facing forward, a user can grasp handles 160 and brace their upper arms and/or elbows on the support pad assemblies 90 and perform seated arm supported bicep curls while their upper alms are supported in a generally vertical position.

Figure 4:
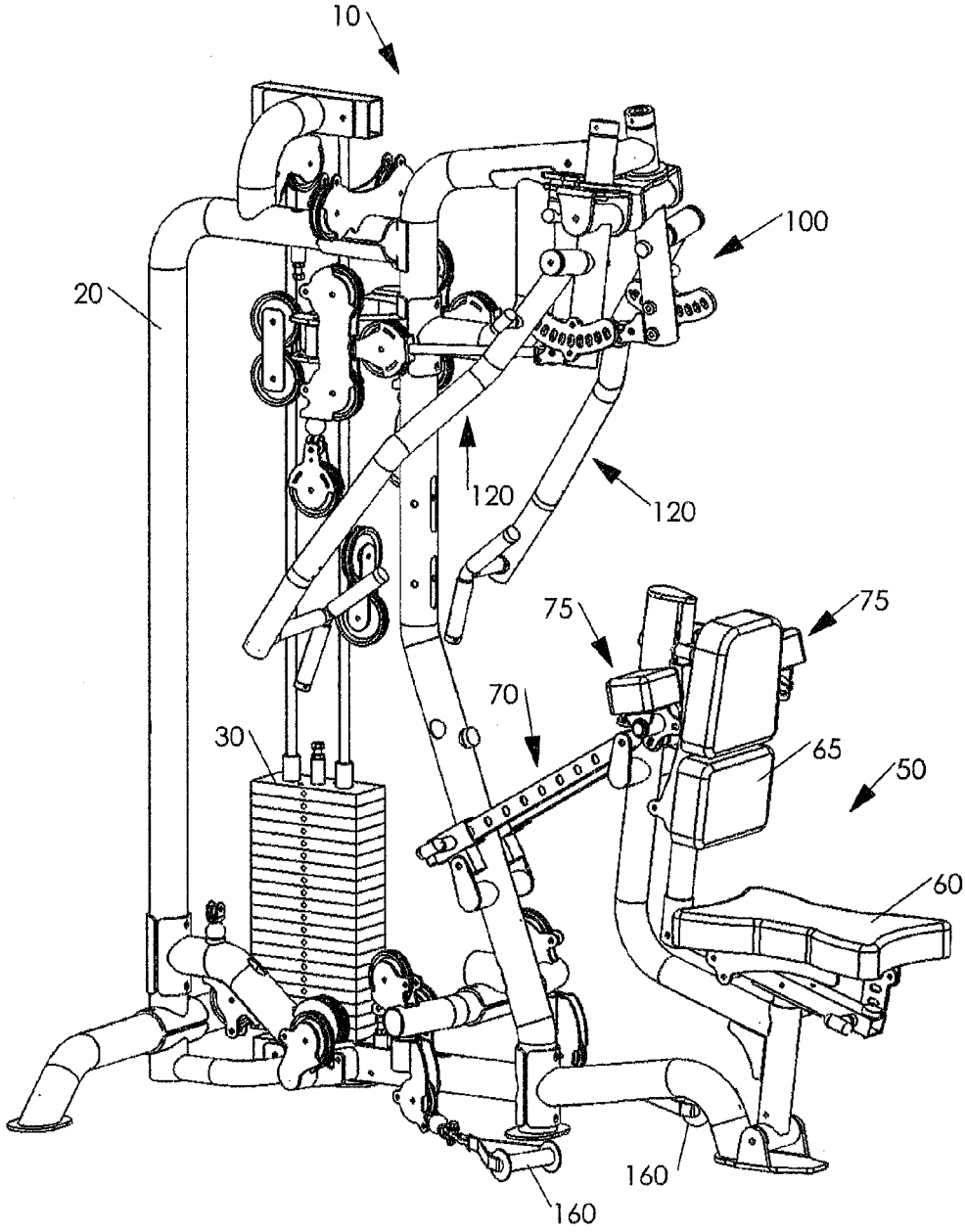
FIG. 4 is a perspective view illustrating an exemplary multi station gym from the front right side wherein the user support assembly is pivotally adjusted towards a forward position, each exercise arm is adjusted into an out of the way position, each bicep curl pad assembly is adjusted into a respective use position, and each support pad assembly is adjusted into a respective generally horizontal position.
Figure 4:
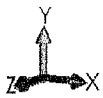

FIG. 4 illustrates each bicep curl pad assembly 75 adjusted into a respective use position wherein each support pad assembly 90 is adjusted into a respective generally horizontal position. The user support assembly 50 is adjusted to a forward position and each second arm section 120 is adjusted to a rearward position engaged with a respective locking plate 111. While sitting on the user support assembly 50 facing towards the back of the gym 10, a user can grasp handles 160 and brace their upper arms and/or elbows on the support pad assemblies 90 and perform seated arm supported bicep curls while their upper arms are supported in a generally horizontal position. The user could also adjust back seat assembly 65 against their chest to provide additional support.

Figure 7:
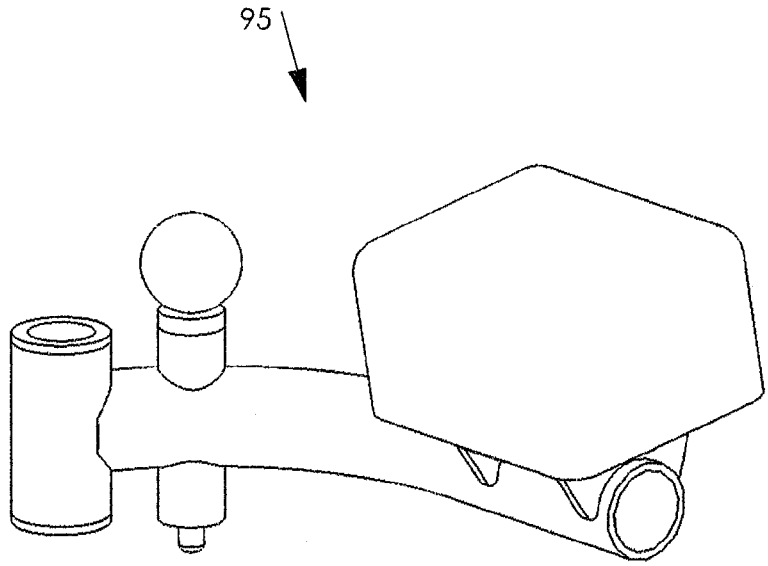
FIG. 7 is an alternate embodiment bicep curl pad assembly.
Figure 7:
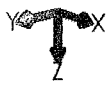

FIG. 7 illustrates an alternate embodiment bicep curl pad assembly 95. A support pad is attached in a fixed position wherein the support part of the pad is in a generally horizontal position. Bicep curl pad assembly 95 could be used in the configuration of multi station gym 10 illustrated in FIG. 4 wherein a user could sit on the user support assembly 50 facing towards the back of the gym 10. The user could then grasp handles 160 and brace their upper arms and/or elbows on the support pads of bicep curl pad assemblies 95 and perform seated arm supported bicep curls while their upper arms are supported in a generally horizontal position.

The present invention could also be carried out wherein a user support assembly was linearly attached to the frame 20 rather than being pivotally attached. This would allow the user support assembly to still be adjustable between a rearward position and a forward position. The adjustable bicep curl pad assemblies 75 could be attached to the linearly adjustable user support assembly which would allow a user to perform seated arm supported bicep curls either facing forward or towards the back of the gym.

The present invention could also be carried out wherein the bicep curl pad assemblies 75 could be attached to a removable user support assembly such as an exercise bench. The removable user support assembly could be positioned in front of the multi station gym 10 at various positions wherein a user could perform seated arm supported bicep curls either facing forward or towards the back of the gym.

Figure 8:
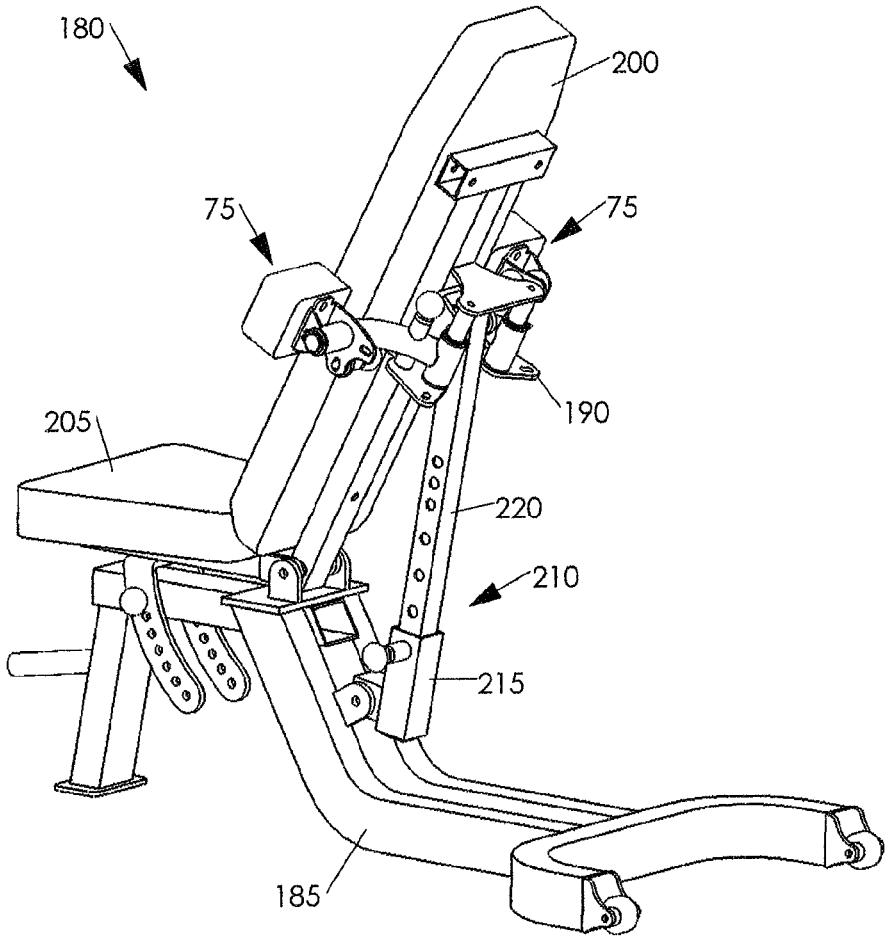
FIG. 8 is a perspective view illustrating an alternate embodiment wherein two bicep curl pad assemblies are pivotally attached to a free standing bench and wherein each bicep curl pad assembly is adjusted into a respective use position, and each support pad assembly is adjusted into a respective generally vertical position.
Figure 8:
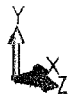

FIG. 8 illustrates an exercise bench 180 with a pair of bicep curl pad assemblies 75 pivotally attached. The exercise bench 180 comprises a frame 185, a back seat assembly 200, and a bottom seat assembly 205. The exercise bench 180 also includes an adjustment mechanism 210 to pivotally adjust the angular position of back seat assembly 200. The adjustment mechanism comprises adjustment sleeve 215 and adjustment tube 220. As illustrated in FIG. 8, the back seat assembly 200 is adjusted towards an upward position, each bicep curl pad assembly 75 is adjusted into a respective use position, and each support pad assembly 90 is adjusted into a respective generally vertical position. The exercise bench 180 could be positioned in front of multi station gym 10 wherein a user could sit on the exercise bench 180 facing forward. The user could then grasp handles 160 and brace their upper arms and/or elbows on the support pads 91 of support pad assemblies 90 and perform seated arm supported bicep curls while their upper arms are supported in a generally vertical position. The user could also use dumbbells as an alternate source of resistance.

Figure 9:
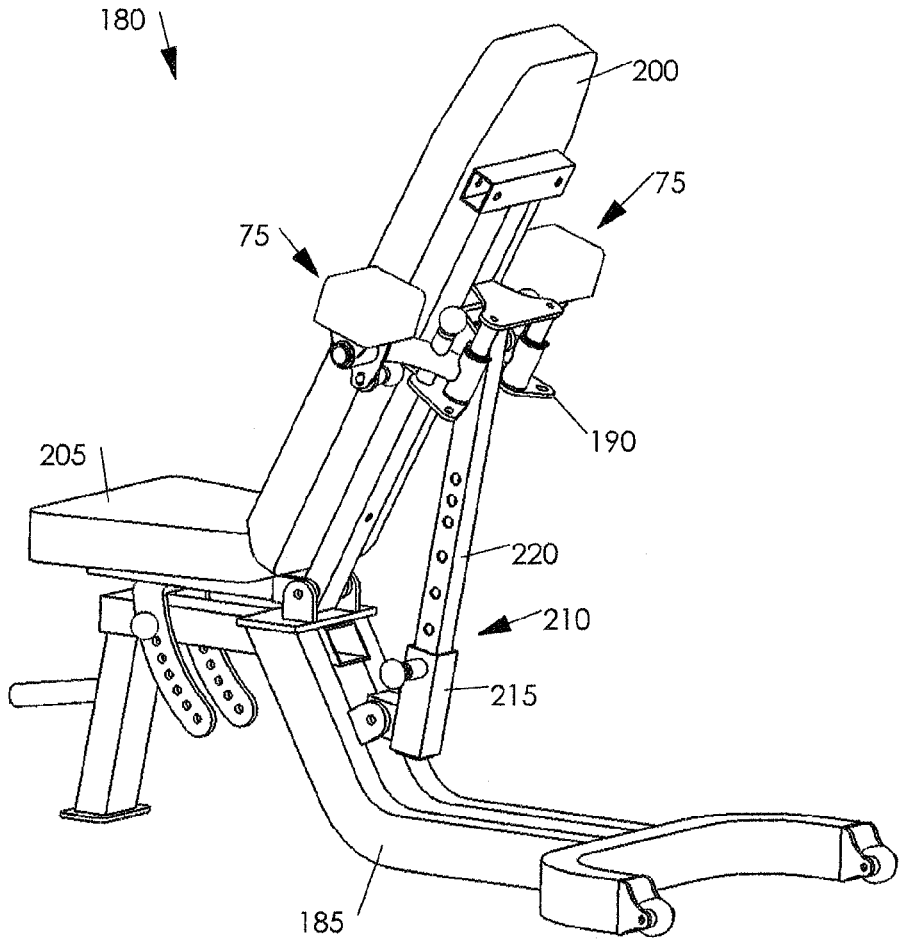
FIG. 9 is a perspective view illustrating an alternate embodiment wherein two bicep curl pad assemblies are pivotally attached to a free standing bench and wherein each bicep curl pad assembly is adjusted into a respective use position, and each support pad assembly is adjusted into a respective generally horizontal position.
Figure 9:
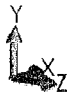

FIG. 9 illustrates bench 180 wherein the back seat assembly 200 is adjusted towards an upward position, each bicep curl pad assembly 75 is adjusted into a respective use position, and each support pad assembly 90 is adjusted into a respective generally horizontal position. The exercise bench 180 could be positioned in front of multi station gym 10 wherein a user could sit on the exercise bench 180 facing rearward. The user could then grasp handles 160 and brace their upper arms and/or elbows on the support pads 91 of support pad assemblies 90 and perform seated arm supported bicep curls while their upper arms are supported in a generally horizontal position. The user could also use dumbbells as an alternate source of resistance.

Figure 10:
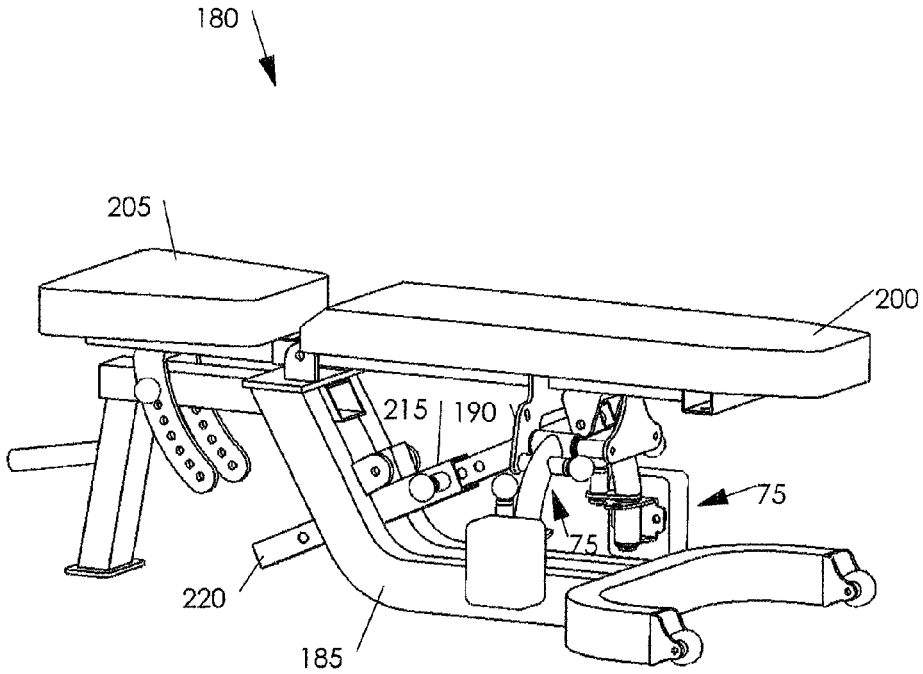
FIG. 10 is a perspective view illustrating an alternate embodiment wherein two bicep curl pad assemblies are pivotally attached to a free standing bench and wherein each bicep curl pad assembly is adjusted into a respective storage position.
Figure 10:
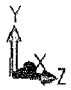

FIG. 10 illustrates exercise bench 180 wherein the back seat assembly 200 is adjusted towards a generally horizontal position and each bicep curl pad assembly 75 is adjusted into a respective storage position. In this adjusted exercise bench 180 position, a user could perform chest press exercises with a resistance source such as free weight dumbbells wherein the bicep curl pad assemblies 75 would not interfere with the users exercise movements. In this position wherein the back seat assembly 200 is adjusted to a generally horizontal position, each bicep curl pad assembly 75 could be adjusted into a respective use position wherein a user could lay in a generally horizontal position facing upward and perform arm supported bicep curls using handles 160 or dumbbells.

The present invention could also be carried out wherein an exercise bench has a seat back and a seat bottom that are fixedly attached to the main support frame. The seat bottom can also be made to be linearly adjustable up and down.

The present invention could also be carried out wherein the bicep curl pivot assemblies 80 are fixedly attached to a user support assembly or exercise bench in permanent use positions wherein respective support pad assemblies 90 are pivotally attached to the bicep curl pivot assemblies 80 and are pivotally adjustable to at least two positions to allow a user to perform arm supported bicep curls in both forward and rearward facing positions.

The present invention may, of course, be carried out in other specific ways than those herein set forth without departing from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. An exercise machine comprising:

a main support frame;

at least one resistance element to provide resistance for performing exercise;

a cable and pulley system connecting at least one exercise station to said resistance element;

an exercise station including two handles connected to said cable and pulley system for pulling to perform bicep curl exercise mounted to said main support frame, said resistance element displaced when said handles are pulled;

an exercise station including two handles connected to said cable and pulley system for pressing or pulling to perform chest press exercise or back row pulling exercise mounted to said main support frame, said resistance element displaced when said handles are pressed or pulled;

an adjustable user support assembly including a seat bottom and a seat back for supporting a user during said exercise, said user support assembly pivotally mounted to said main support frame wherein said seat bottom and said seat back are rotatable and adjustable as a unit to multiple fixed positions along a curved path;

a locking mechanism to lock said user support assembly into said multiple fixed positions;

a left and a right pivot arm assembly pivotally mounted to said user support assembly behind and adjacent to said seat back, each said pivot arm assembly rotatable about a respective first axis between a first fixed position and a second fixed position;

at least one locking mechanism to lock said left pivot arm assembly into said first and second fixed positions;

at least one locking mechanism to lock said right pivot arm assembly into said first and second fixed positions;

a left and a right arm pad assembly pivotally mounted to respective said left and right pivot arm assemblies, each said arm pad assembly including an arm pad for supporting a user's elbow or back of the upper arm during bicep curl exercise, each said arm pad assembly rotatable about a respective second axis to multiple fixed positions;

at least one locking mechanism to lock said left arm pad assembly into said multiple fixed positions;

at least one locking mechanism to lock said right arm pad assembly into said multiple fixed positions; and wherein said left and right arm pads are disposed behind said seat back when said pivot arm assemblies are adjusted to respective said first fixed positions to allow a clear path for said user's arms while grasping said handles during chest press or back row exercise, and disposed generally along respective sides of said seat back for supporting said user's respective elbow or back of the upper arm during bicep curl exercise when said pivot arm assemblies are adjusted to respective said second fixed positions, and wherein said seat bottom, said seat back, and said arm pads can be adjusted together as a unit along a curved path into multiple fixed positions to vary the distance from said handles of said bicep curl station to allow said user to sit on said user support assembly and perform elbow or back of the upper arm supported bicep curl exercise in forward or rearward facing directions with the proper range of motion, and wherein each said arm pad remains in a fixed position during bicep curl exercise.

2. The exercise machine of claim 1 wherein each said first axis is generally perpendicular with a respective said second axis such that the rotation of each said pivot arm assembly is generally perpendicular to the rotation of a respective said arm pad assembly.

3. The exercise machine of claim 1 wherein each said second axis is generally parallel with the face of each respective said arm pad, said face of each said arm pad being defined as the surface of said arm pad that supports said user's elbow or back of the upper arm during bicep curl exercise.

4. The exercise machine of claim 1 wherein each said second axis is positioned adjacent and behind a respective said arm pad.

5. The exercise machine of claim 3 wherein each said second axis is positioned behind and coincident with the centerline of a respective said arm pad.

6. The exercise machine of claim 1 wherein each said arm pad is adjustable to a fixed position wherein the face of each said arm pad is generally parallel with the face of said seat back, said face of each said arm pad being defined as the surface of said arm pad that supports said user's elbow or back of the upper arm during bicep curl exercise and said face of said seat back being defined as the surface of said seat back that supports said user during exercise.

7. The exercise machine of claim 1 wherein each said arm pad is adjustable to a fixed position wherein the face of each said arm pad is generally perpendicular with the face of said seat back, said face of each said arm pad being defined as the surface of said arm pad that supports said user's elbow or back of the upper arm during bicep curl exercise and said face of said seat back being defined as the surface of said seat back that supports said user during exercise.

8. The exercise machine of claim 1 wherein said seat bottom is pivotally mounted to said user support assembly.

9. The exercise machine of claim 1 wherein said seat back is pivotally mounted to said user support assembly.

10. The exercise machine of claim 1 wherein said user support assembly is pivotally adjustable along said curved path between a first fixed position and a second fixed position that varies the distance of said seat bottom, said seat back, and said arm pads from said handles of said bicep curl station by at least one foot.

11. An exercise machine comprising:

a main support frame;

at least one resistance element to provide resistance for performing exercise;

a cable and pulley system connecting at least one exercise station to said resistance element;

an exercise station including two handles connected to said cable and pulley system for pulling to perform bicep curl exercise mounted to said main support frame, said resistance element displaced when said handles are pulled;

an exercise station including two handles connected to said cable and pulley system for pressing or pulling to perform chest press exercise or back row pulling exercise mounted to said main support frame, said resistance element displaced when said handles are pressed or pulled;

an adjustable user support assembly including a seat bottom and a seat back for supporting a user during said exercise, said user support assembly linearly mounted to said main support frame wherein said seat bottom and said seat back are linearly adjustable as a unit to multiple fixed positions along a generally horizontal linear path;

a locking mechanism to lock said user support assembly into said multiple fixed positions;

a left and a right pivot arm assembly pivotally mounted to said user support assembly behind and adjacent to said seat back, each said pivot arm assembly rotatable about a respective first axis between a first fixed position and a second fixed position;

at least one locking mechanism to lock said left pivot arm assembly into said first and second fixed positions;

at least one locking mechanism to lock said right pivot arm assembly into said first and second fixed positions;

a left and a right arm pad assembly pivotally mounted to respective said left and right pivot arm assemblies, each said arm pad assembly including an arm pad for supporting a user's elbow or back of the upper arm during bicep curl exercise, each said arm pad assembly rotatable about a respective second axis to multiple fixed positions;

at least one locking mechanism to lock said left arm pad assembly into said multiple fixed positions;

at least one locking mechanism to lock said right arm pad assembly into said multiple fixed positions; and wherein said left and right arm pads are disposed behind said seat back when said pivot arm assemblies are adjusted to respective said first fixed positions to allow a clear path for said user's arms while grasping said handles during chest press or back row exercise, and disposed generally along respective sides of said seat back for supporting said user's respective elbow or back of the upper arm during bicep curl exercise when said pivot arm assemblies are adjusted to respective said second fixed positions, and wherein said seat bottom, said seat back, and said arm pads can be adjusted together as a unit along a generally horizontal linear path into multiple fixed positions to vary the distance from said handles of said bicep curl station to allow said user to sit on said user support assembly and perform elbow or back of the upper arm supported bicep curl exercise in forward or rearward facing directions with the proper range of motion, and wherein each said arm pad remains in a fixed position during bicep curl exercise.

12. The exercise machine of claim 11 wherein each said first axis is generally perpendicular with a respective said second axis such that the rotation of each said pivot arm assembly is generally perpendicular to the rotation of a respective said arm pad assembly.

13. The exercise machine of claim 11 wherein each said second axis is generally parallel with the face of each respective said arm pad, said face of each said arm pad being defined as the surface of said arm pad that supports said user's elbow or back of the upper arm during bicep curl exercise.

14. The exercise machine of claim 11 wherein each said second axis is positioned adjacent and behind a respective said arm pad.

15. The exercise machine of claim 13 wherein each said second axis is positioned behind and coincident with the centerline of a respective said arm pad.

16. The exercise machine of claim 11 wherein each said arm pad is adjustable to a fixed position wherein the face of each said arm pad is generally parallel with the face of said seat back, said face of each said arm pad being defined as the surface of said arm pad that supports said user's elbow or back of the upper arm during bicep curl exercise and said face of said seat back being defined as the surface of said seat back that supports said user during exercise.

17. The exercise machine of claim 11 wherein each said arm pad is adjustable to a fixed position wherein the face of each said arm pad is generally perpendicular with the face of said seat back, said face of each said arm pad being defined as the surface of said arm pad that supports said user's elbow or back of the upper arm during bicep curl exercise and said face of said seat back being defined as the surface of said seat back that supports said user during exercise.

18. The exercise machine of claim 11 wherein said seat bottom is pivotally mounted to said user support assembly.

19. The exercise machine of claim 11 wherein said seat back is pivotally mounted to said user support assembly.

20. The exercise machine of claim 11 wherein said user support assembly is linearly adjustable along said generally horizontal linear path between a first fixed position and a second fixed position that varies the distance of said seat bottom, said seat back, and said arm pads from said handles of said bicep curl station by at least one foot.

* * * * *